US012588734B2

(12) United States Patent
Jeon

(10) Patent No.: US 12,588,734 B2
(45) Date of Patent: Mar. 31, 2026

(54) DUSTPROOF WORK SHOE WITH ANTISTATIC INSOLE USING RECYCLED PET AND DUSTPROOF RUBBER OUTSOLE CAPABLE OF BEING STEAM-STERILIZED

(71) Applicant: Eun Gyum Jeon, Busan (KR)

(72) Inventor: Eun Gyum Jeon, Busan (KR)

( * ) Notice: Subject to any disclaimer, the term of this patent is extended or adjusted under 35 U.S.C. 154(b) by 290 days.

(21) Appl. No.: 18/372,432

(22) Filed: Sep. 25, 2023

(65) Prior Publication Data

US 2025/0072554 A1 Mar. 6, 2025

(30) Foreign Application Priority Data

Sep. 6, 2023 (KR) ..... 10-2023-0118087

(51) Int. Cl.

| | |
|---|---|
| ***A43B 7/36*** | (2006.01) |
| ***A43B 1/00*** | (2006.01) |
| ***A43B 17/00*** | (2006.01) |

(52) U.S. Cl.

CPC ..... *A43B 7/36* (2013.01); *A43B 1/0063* (2013.01); *A43B 17/003* (2013.01)

(58) Field of Classification Search

None

See application file for complete search history.

(56) References Cited

FOREIGN PATENT DOCUMENTS

| | | | | | |
|---|---|---|---|---|---|
| JP | H09-276002 | A | | 10/1997 | |
| KR | 20210055113 | A | * | 5/2021 | ..... A43B 7/38 |
| KR | 20220087636 | A | * | 6/2022 | ..... C08L 9/00 |
| KR | 10-2023-0071867 | A | | 5/2023 | |
| WO | WO 2008/013060 | A1 | | 1/2008 | |

OTHER PUBLICATIONS https://patents.google.com/patent/KR20220087636A/en?q=(weight)&q=(parts)&q=(dustproof)&q=(insole)&q=(outsole)&q=(graphene)&q=(%22nickel+plated+copper%22)&before=priority:20230906&scholar (Year: 2020).* https://patents.google.com/patent/KR20210055113A/en?oq=KR20210055113 (Year: 2019).*

Korean Office Action for related KR Application No. 10-2023-0118087 mailed Jan. 16, 2025 from Korean Intellectual Property Office.

* cited by examiner

*Primary Examiner* — Arti Singh-Pandey

(74) *Attorney, Agent, or Firm* — Paratus Law Group, PLLC

(57) ABSTRACT

A dustproof work shoe using recycled PET, includes: an outsole made of a conductive rubber portion; and an insole being laid on the top of the outsole and having electrical conductivity. The insole is made using a nickel-plated copper fabric in combination with a carbon-graphene yarn and provided in the bottom of the shoe that comes into contact with the foot. The insole is made of recycled PET.

1 Claim, 5 Drawing Sheets

DUSTPROOF WORK SHOE WITH ANTISTATIC INSOLE USING RECYCLED PET AND DUSTPROOF RUBBER OUTSOLE CAPABLE OF BEING STEAM-STERILIZED

CROSS-REFERENCE TO RELATED APPLICATION

This application claims priority to Korean Patent Application No. 10-2023-0118087 (filed on Sep. 6, 2023), which is hereby incorporated by reference in its entirety.

BACKGROUND

The present invention relates to a dustproof work shoe including an antistatic insole using recycled PET and a dustproof rubber outsole having electrical resistance and capable of being steam-sterilized. The low-carbon emission antistatic insole, made of PET recycled through chemical degradation, prevents the build-up of static electricity within the human body, while the dustproof outsole, made of a high content of styrene, is designed for steam sterilization and slip resistance.

A dustproof work shoe is a type of footwear with soles and dustproof fabrics using special materials that offer both antistatic properties and minimal particle generation in order to control the generation of static electricity in a clean room environment, similar to dustproof clothing. Additionally, clean room garments in the manufacturing environment according to the GMP standards for bio-health and pharmaceutical production are subjected to an additional process of high-pressure steam sterilization at 121° C. for 15 minutes. Dustproof footwear used in the production lines are ergonomically designed with materials suitable for intended purposes, ensuring that workers can wear them for extended periods with minimal fatigue.

The dustproof work shoes can neutralize some of the static electricity generated by the movement of the human body, and the rest of the static electricity is supposed to be dissipated through the grounding of the clean room floor via the conductive yarns of the dustproof work shoes. The dustproof work shoes are worn to serve as a conduit for static electricity between the dustproof clothing and the floor surface, resulting in a more effective static control measure.

However, dustproof footwear generally manufactured and commercially available do not include dustproof work shoes containing recycled materials, and they are equipped with heavy outsoles, offer insignificant antistatic effects and low slip resistance (in the case of having lightweight dustproof rubber outsoles), and undergo deformation during steam sterilization. Therefore, the present invention aims to provide a dustproof work shoe including an antistatic insole using recycled PET and a dustproof rubber outsole capable of being steam-sterilized.

SUMMARY

The present invention has been conceived to address the above-mentioned problems, and its object is to provide a dustproof work shoe including an inner lining and an antistatic insole made of recycled PET.

It is another object of the present to provide a dustproof work shoe that includes an antistatic insole made of recycled PET to prevent the build-up of static electricity and exhibits excellent properties in terms of slip resistance due to a high content of styrene, while maintaining the antistatic effect.

It is further another object of the present invention to provide a dustproof work shoe that includes a dustproof insole made of recycled PET and exhibits excellent properties in terms of stable electrical resistance without changes in appearance during high-pressure stream sterilization.

The technical challenges that the invention aims to address are not limited to those mentioned above, and other technical challenges not mentioned will be clearly understood by those skilled in the art in the relevant field from the following description.

According to the present invention, there is provided a dustproof work shoe that includes an antistatic insole using recycled PET and a dustproof rubber outsole capable of being steam-sterilized, where the dustproof work shoe comprises an outsole made of a conductive rubber portion; and an insole being laid on the top of the outsole and having electrical conductivity. The insole is made using a nickel-plated copper fabric in combination with a carbon-graphene yarn and provided in the bottom of the shoe that comes into contact with the foot. The insole is made of recycled PET.

The outsole has an electrical resistance of $10^6$ to $10^8\Omega$.

The outsole is manufactured by mixing 18 to 22 parts by weight of natural rubber, 8 to 12 parts by weight of butadiene rubber, 48 to 52 parts by weight of nitrile butadiene rubber, 1 to 3 parts by weight of styrene-butadiene rubber, 22 to 26 parts by weight of silicon oxide, 5 to 7 parts by weight of magnesium carbonate, 1 to 2 parts by weight of polyethylene glycol, 2 to 3 parts by weight of zinc oxide, 1 to 2 parts by weight of sulfur, 1 to 3 parts by weight of titanium dioxide, and 5 to 6 parts by weight of an antistatic agent, with respect to 1 part by weight of stearic acid.

Through the means of the solutions, the present invention can provide a dustproof work shoe that includes an inner lining and an antistatic insole made of recycled PET and a dustproof outsole.

The present invention can also provide a dustproof work shoe that includes a low-carbon-emission antistatic insole made of recycled PET, where the insole has an antistatic performance satisfying the standards and exhibits excellent properties in terms of slip resistance and electrical resistance without deformation by steam sterilization.

The present invention can also provide a dustproof work shoe that includes an antistatic insole made of recycled PET, where the antistatic insole has excellent properties in terms of rubbing fastness and wash fastness.

DETAILED DESCRIPTION

Hereinafter, the terms used in this specification will be briefly described and a detailed description of the present invention will be provided.

The terminology used in this invention has been selected to reflect widely used common terms, considering the functionality in the context of the present invention. However, these terms may vary depending on the intentions of those skilled in the art, legal precedents, or the emergence of new technologies. Therefore, the terms used in this invention should be defined not merely by their names but based on their meaning and their application throughout the entirety of this invention.

Throughout the specification, unless specified otherwise, the terms "comprises" and/or "comprising" specify the presence of the stated component but do not preclude the presence of one or more other components.

Below, a detailed description are given as to the embodiments of the present invention with reference to the accompanying drawings in order to facilitate the implementation of the present invention by those skilled in the art. However, this invention can also be implemented in various forms and is not limited to the embodiments described herein.

Specific details, including the problems to be addressed by the present invention, the means to address them, and the advantages and features of the invention, are included in the following exemplary embodiments and drawings. The benefits and characteristics of the invention, as well as how they are achieved, will become clear when referring to the detailed examples provided with the attached drawings.

Hereinafter, the present invention will be described in further detail with reference to the accompanying drawings.

The present invention relates to a dustproof footwear that includes an antistatic insole using recycled PET and a dustproof rubber outsole capable of being steam-sterilized. The dustproof footwear is designed so that the inner lining and the antistatic insole made of PET recycled by chemical degradation can prevent the build-up of static electricity. The dustproof footwear according to the present invention may be designed as a work shoe shown in FIGS. 1-4.

In conventional cases, dustproof footwear using recycled PET is not available, and the soles are made of a conductive rubber instead of polyurethane (PU). Contrarily, the present invention is directed to a dustproof footwear that includes an antistatic insole using recycled PET and a dustproof outsole excellent in anti-slip performance and capable of being steam-sterilized.

Figure 1:
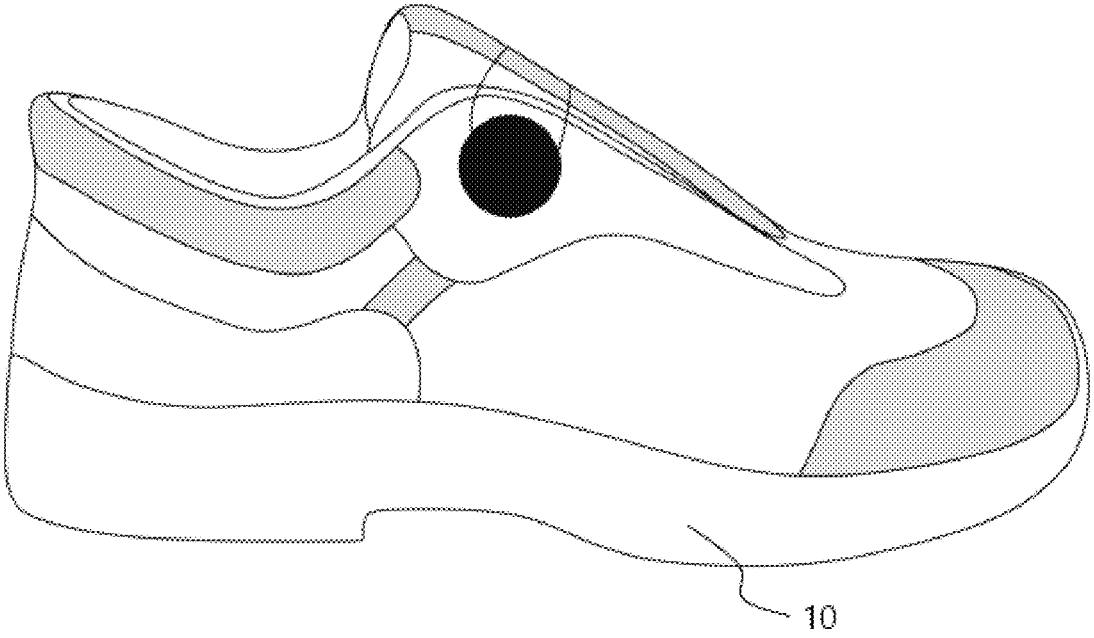
FIG. 1 is a photo showing the right side of the dustproof work shoe according to an embodiment of the present invention.
Figure 2:
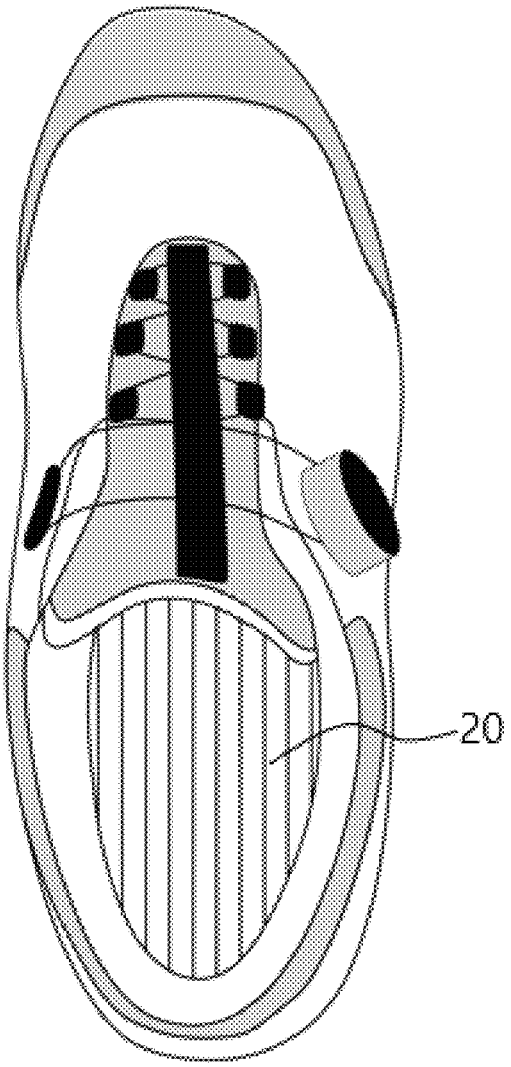
FIG. 2 is a photo showing the front side of the dustproof work shoe according to an embodiment of the present invention.
Figure 3:
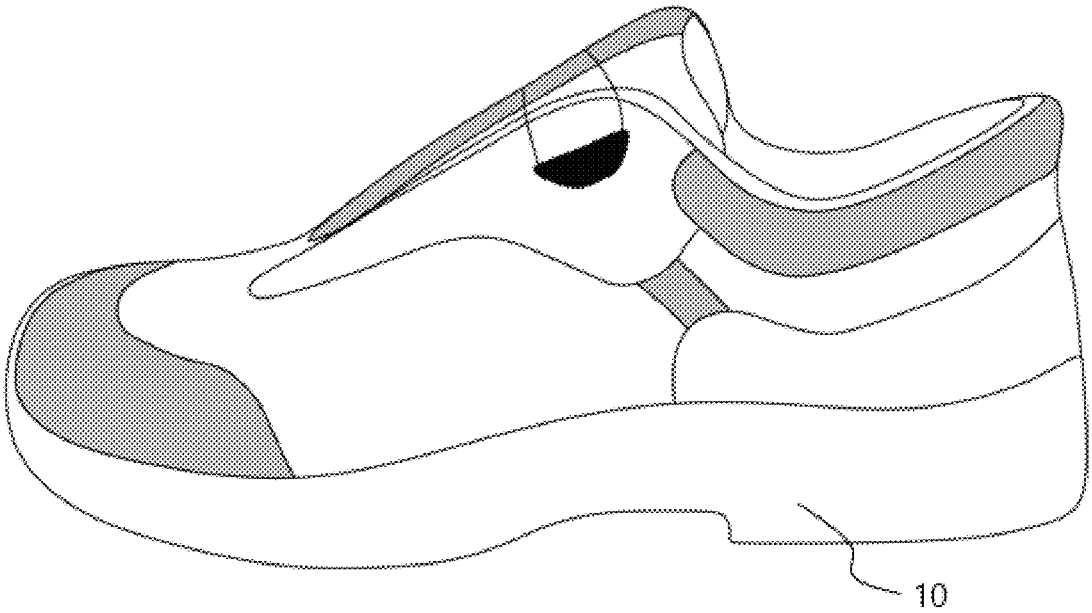
FIG. 3 is a photo showing the left side of the dustproof work shoe according to an embodiment of the present invention.
Figure 4:
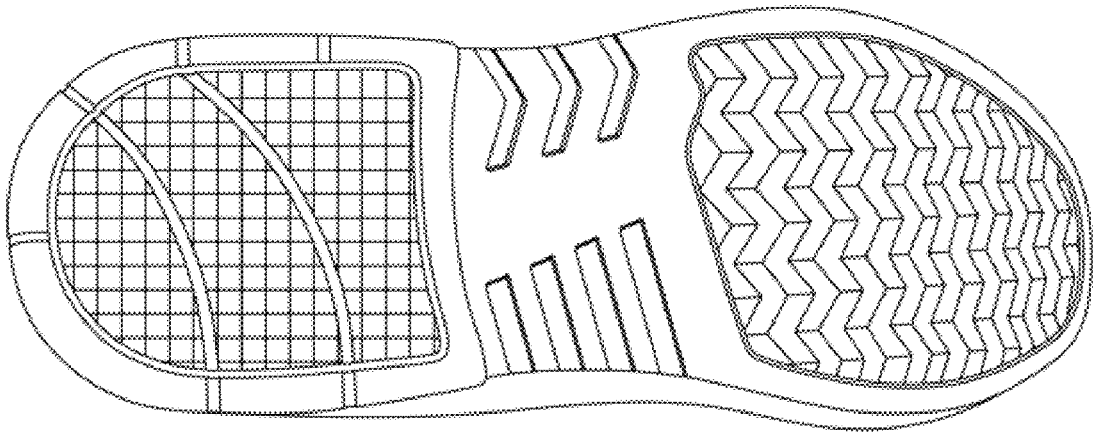
FIG. 4 is a photo showing the bottom of the dustproof work shoe according to an embodiment of the present invention.
Figure 5:
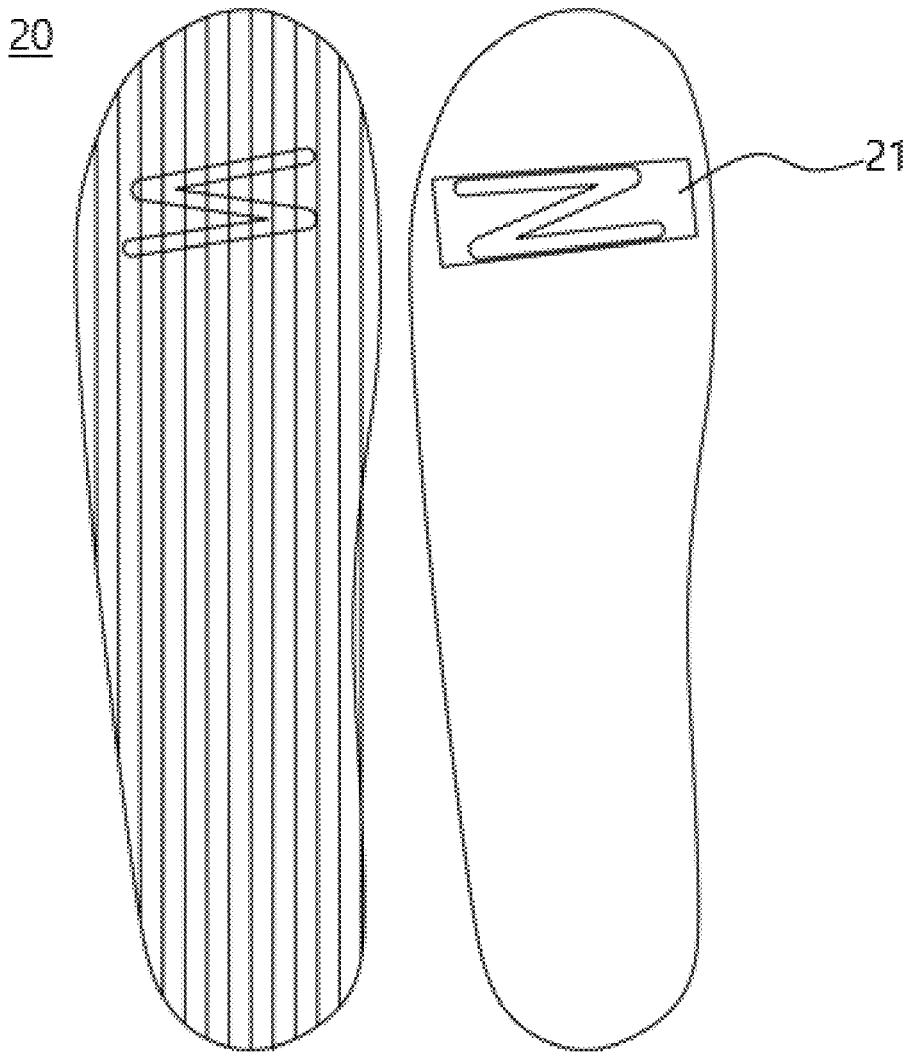
FIG. 5 is a photo showing the insole of the dustproof work shoe according to an embodiment of the present invention.
Figure 6:
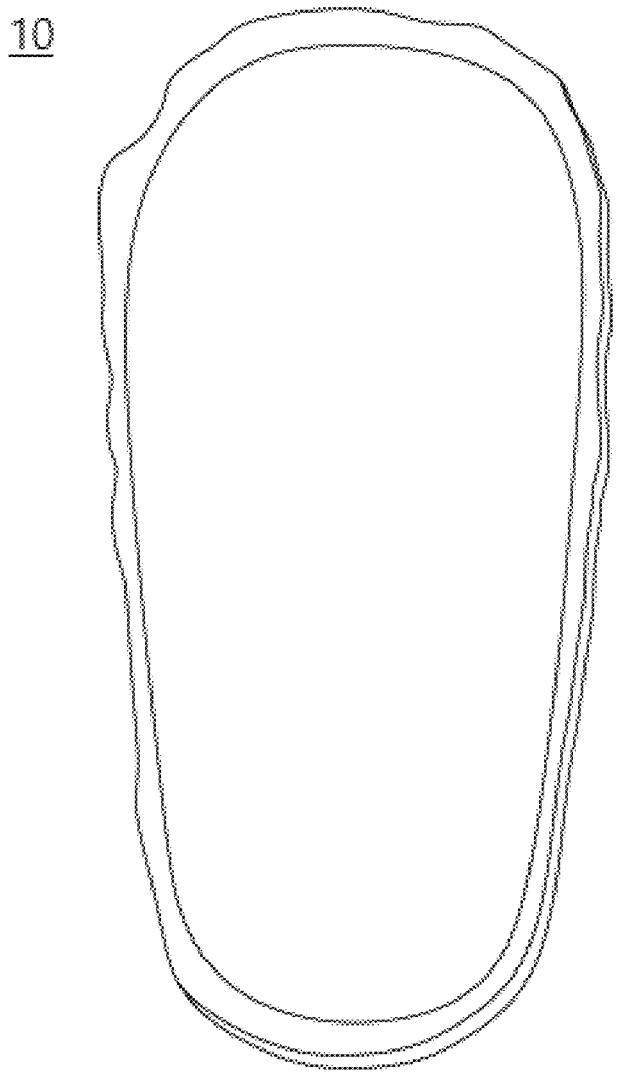
FIG. 6 is a photo showing the outsole of the dustproof work shoe according to an embodiment of the present invention.

The dustproof work shoe that includes an inner lining and an antistatic insole using recycled PET and a dustproof rubber outsole capable of being steam-sterilized according to the present invention is provided with an outsole 10 and an insole 20, as shown in FIGS. 5 and 6.

Firstly, the outsole 10 is made of a rubber portion with a low specific gravity and offers electrical conductivity. On the top of the outsole 10 is laid the insole 20. The outsole 10 is provided to encase the sides of the insole 20.

The dustproof work shoe of the present invention also includes an inner lining that is made of recycled PET and provided inside the shoe. It further includes an upper laid on the opposite side of the inner lining, and shoe laces of a dial system attached to the upper. The inner lining includes recycled PET.

The outsole is preferably made of a rubber portion.

Preferably, the outsole has an electrical resistance of $10^6$ to $10^8\Omega$. According to the global industrial safety standards, clean room shoes are required to have an electrical resistance ranging from $10^5$ to $10^8\Omega$.

The rubber portion of the outsole may be manufactured by mixing 18 to 22 parts by weight of natural rubber, 8 to 12 parts by weight of butadiene rubber, 48 to 52 parts by weight of nitrile butadiene rubber, 1 to 3 parts by weight of styrene-butadiene rubber, 22 to 26 parts by weight of silicon oxide, 5 to 7 parts by weight of magnesium carbonate, 1 to 2 parts by weight of polyethylene glycol, 2 to 3 parts by weight of zinc oxide, 1 to 2 parts by weight of sulfur, 1 to 3 parts by weight of titanium dioxide, and 5 to 6 parts by weight of an antistatic agent, with respect to 1 part by weight of stearic acid. In addition, the recycled PET may be included in the rubber portion of the outsole.

The styrene-butadiene rubber, excellent in thermal resistance and abrasion resistance, is used to reinforce the hardness and serve as a plasticizer at high temperatures.

The stearic acid is used as a dispersing and elasticity-reinforcing agent.

The magnesium carbonate is to increase the slip resistance of the dustproof work shoe.

The silicon dioxide enhances friction performance.

The polyethylene glycol is used as a surfactant, lubricant, and preservative.

The zinc oxide blocks UV rays and serves as a crosslinking agent due to its high thermal resistance.

The sulfur is used as a vulcanizing and crosslinking agent.

The antistatic agent is primarily composed of polyethylene glycol ester and used to offer an antistatic effect due to its electrical conductivity.

Furthermore, the outsole includes a mix of a thiuram-based crosslinking accelerator as a primary accelerator and a thiazole-based crosslinking accelerator as secondary and tertiary accelerators. The mix is prepared by mixing 0.05 to 0.15 part by weight of the primary accelerator, 0.3 to 0.7 part by weight of the secondary accelerator, and 0.5 to 1.5 part by weight of the tertiary accelerator, with respect to 1 part by weight of the stearic acid.

Preferably, the primary accelerator is thiram, the secondary accelerator is dibenzothiazyl disulfide (MBTS), and the tertiary accelerator is mercaptobenzothiazole.

Thiuram as the primary accelerator has a molecular formula of $((CH_3)_2—N—C—S)_2—S_2$.

The secondary accelerator, dibenzothiazyl disulfide (MBTS), has a structural formula as given by the chemical formula 1 below. The secondary accelerator is the most commonly used accelerator in the rubber industry, offering superior temperature properties compared to the tertiary accelerator and preventing premature curing and scorching. It is also safe to handle and recommended to use in combination with the primary accelerator.

[Chemical Formula 1]

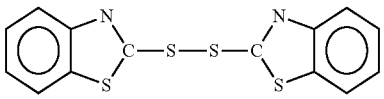

(M.W. = 332.49)

The tertiary accelerator, mercaptobenzothiazole, has a molecular formula $C_7H_5NS_2$.

Next, the insole is laid on the top of the outsole and offers electrical conductivity. The insole is characterized by containing recycled PET. The insole, which includes recycled PET, exhibits an antistatic effect with a surface resistance of $10^7\Omega$ and water repellent properties (ISO 4). Insoles commonly available are made of EVA, which lacks breathability but is lightweight and elastic.

The insole further includes an insole pattern portion 21 on the one side that comes into contact with the foot. The insole pattern portion is sewn using a nickel-plated copper fabric with a carbon-graphene yarn in order to prevent oxidation. More stitches means the more uneven bottom that causes a discomfort when the shoe is worn. It is therefore desirable to use a copper fabric plated with nickel that has a large surface area, so it can be connected to the bottom of the shoe in order to increase the efficiency. In other words, the insole pattern portion makes it possible to establish a structure that allows for electrical conductivity while maintaining a comfort inside the shoe.

The following is the composition of the rubber portion of the outsole as an example. Table 1 shows the quantities and proportions of the ingredients in the rubber portion.

TABLE 1

| Ingredients | Quantities | Proportions | Features |
|---|---|---|---|
| Natural rubber | 10 | 15.71 | |
| Butadiene rubber | 5 | 7.86 | |
| Nitrile butadiene rubber | 25 | 39.28 | |
| Styrene-butadiene rubber | 1 | 1.57 | Used for reinforcing hardness and serves as a plasticizer at high temperatures |
| Stearic acid | 0.5 | 0.79 | Increases dispersion and elasticity |
| Silicon oxide (silica) | 12 | 18.85 | Enhances friction performance |
| Magnesium carbonate ($MgCO_3$) | 3 | 4.71 | Prevents slips |
| Polyethylene glycol | 0.7 | 1.10 | Surfactant, lubricant and preservative |
| Zinc oxide | 1.3 | 2.04 | Blocks UV rays and activates crosslinage due to high thermal resistance |
| Primary accelerator | 0.05 | 0.08 | Thiuram-based crosslinking accelerator |
| Secondary accelerator | 0.25 | 0.39 | Thiazole-based crosslinking accelerator |
| Tertiary accelerator | 0.55 | 0.86 | Thiazole-based crosslinking accelerator |
| Sulfur | 0.7 | 1.10 | Vulcanizing/Crosslinking agent |
| Titanium dioxide | 1 | 1.57 | |
| Antistatic agent | 2.6 | 4.08 | |
| Total | 63.65 | 100.00 | |

The outsole of the dustproof work shoe using recycled PET according to the present invention was subjected to the tensile strength, tearing strength, abrasion resistance, and slip resistance tests. The results are presented in Table 2.

The experimental tests on the outsole were conducted through the FITI Testing and Research Institute. The slip resistance test (specimen size: 265 mm, installation site: shoe tree, test surface: stainless steel) was performed in accordance with KS M ISO 13287:2015.

TABLE 2

| Test items | | Results | Test methods |
|---|---|---|---|
| Tensile strength (MPa) | | 14.1 | KS M 6518:2018 (Dumbbell type 3) |
| Tearing strength (N/mm) | | 52.7 | KS M 6518:2018 (B type) |
| Hardness (Hs) | | 65 | KS M 6518:2021 (A type) |
| Abrasion resistance (%) | | 116 | KS M 6625:2018 |
| Density ($Mg/m^3$) | | 1.348 | KS M ISO 2781:2018 |
| Slip resistance (Friction factor) | Primary | 0.61 | KS M ISO 13287:2015 |
| | Secondary | 0.49 | Test surface: Stainless steel Surface: 0.5% detergent Angle: tested on the heel |

The outsole of the dustproof work shoe using recycled PET according to the present invention was subjected to the surface resistivity test. The results are presented in Table 3.

The experimental tests on the outsole were conducted through the FITI Testing & Research Institute, and the surface resistivity (the outer circle diameter of the inner electrode 1.96 cm, inner circle diameter of the surface fantasy electrode 2.41 cm) was performed in accordance with ASTM D 257-2007.

TABLE 3

| Test item | Results |
|---|---|
| Surface resistivity (Ω) | Less than $3.5 \times 10^7$ |

The surface resistivity, wash fastness, and rubbing fastness tests were carried out on the insole of the dustproof work shoes using recycled PET according to the present invention. The test results are presented in Table 4.

The experimental tests on the insole were conducted through the FITI Testing and Research Institute. Surface resistivity (test conditions: 100V, 1 minute, test equipment: SHIMADZU, STABLO-AP, friction conditions: KS K ISO 105 X12: 2016) was measured according to KS K 0170: 2019. The wash fastness test (washing temperature: 40±2° C., washing time: 30 minutes, 0.4% ECE standard detergent, 0.1% sodium tripolyphosphate, stainless steel balls 10) was carried out according to KS K ISO C06:2010. Further, the rubbing fastness test was conducted in accordance with KS K ISO 105 X12: 2016.

TABLE 4

| Test items | | | Results |
|---|---|---|---|
| Surface resistivity (Ω) before rubbing | | | Less than $1.9 \times 10^7$ |
| Surface resistivity (Ω) after rubbing | | Dry | Less than $1.9 \times 10^7$ |
| | | Wet | Less than $1.9 \times 10^7$ |
| Wash fastness | Color change | | 4-5 |
| | Contamination | Cotton | 4-5 |
| | | Polyester | 4-5 |
| Rubbing fastness | Wale | Dry | 4-5 |
| | | Wet | 4-5 |
| | course | Dry | 4-5 |
| | | Wet | 4 |

The outsole was evaluated in regards to the change in the length (shrinkage rate, %) and appearance resulting from heating. The results are presented in Table 5.

The shrinkage rate and appearance tests on the outsole were conducted through the FITI Testing and Research Institute. The test equipment was PC-422R8, HIRAYAMA, and the aging conditions were 121° C., 100% R.H. for 15 minutes. The shrinkage rate (%) was determined as given by:

$$(\text{Length after the test} - \text{Length before the test})/\text{Length before the test} \times 100.$$

TABLE 5

| Test items | Results |
|---|---|
| Shrinkage rate (%) | 0.5 |
| Appearance (Visual evaluation) | No changes (e.g., swelling, shrinking, splitting) |

By means of the solutions, the present invention can provide a dustproof footwear that includes an inner lining and an antistatic insole made of recycled PET and a dustproof outsole capable of being steam-sterilized.

The present invention can also provide a dustproof footwear that includes a low-carbon-emission antistatic insole made of recycled PET, where the insole prevents the build-up of static electricity within the human body and has a high content of styrene to exhibit excellent properties in terms of slip resistance while maintaining the antistatic effect.

The present invention can also provide a dustproof footwear that includes a dustproof insole made of recycled PET, resulting in stable electrical resistance and no change in appearance by high-pressure steam sterilization.

In this manner, it should be apparent to those skilled in the art that the technical configuration of the present invention as described above can be implemented in other specific forms without altering the technical concept or essential features of the present invention.

Therefore, the embodiments described above are exemplary in all respects and should be construed as non-limiting. The scope of the present invention is defined by the claims appended hereto, and all modifications or variations derived from the meaning and scope of the claims, as well as equivalent concepts, are to be included within the scope of the present invention.

What is claimed is:

1. A dustproof work shoe using recycled PET, comprising:

an outsole comprising a conductive rubber portion;

an insole being laid on the top of the outsole and having electrical conductivity, and an insole pattern portion located on a side of the insole that comes into contact with a foot, wherein the insole pattern portion comprises a nickel-plated copper fabric in combination with a carbon-graphene, wherein:

the insole comprises recycled PET, the outsole has an electrical resistance of $10^6$ to $10^8\Omega$, the outsole is manufactured by mixing 18 to 22 parts by weight of natural rubber, 8 to 12 parts by weight of butadiene rubber, 48 to 52 parts by weight of nitrile butadiene rubber, 1 to 3 parts by weight of styrene-butadiene rubber, 22 to 26 parts by weight of silicon oxide, 5 to 7 parts by weight of magnesium carbonate, 1 to 2 parts by weight of polyethylene glycol, 2 to 3 parts by weight of zinc oxide, 1 to 2 parts by weight of sulfur, 1 to 3 parts by weight of titanium dioxide, and 5 to 6 parts by weight of an antistatic agent, with respect to 1 part by weight of stearic acid the rubber portion comprises a mix of a thiuram-based crosslinking accelerator as a primary accelerator and a thiazole-based crosslinking accelerator as secondary and tertiary accelerators, and the primary accelerator is thiuram, the secondary accelerator is dibenzothiazyl disulfide (MBTS), and the tertiary accelerator is mercaptobenzothiazole.

* * * * *